US009420374B2

(12) United States Patent
Ko et al.

(10) Patent No.: US 9,420,374 B2
(45) Date of Patent: Aug. 16, 2016

(54) APPARATUS AND METHOD FOR FOCUSING SOUND IN ARRAY SPEAKER SYSTEM

(75) Inventors: Sang-chul Ko, Seoul (KR); Young-tae Kim, Seongnam-si (KR); Jung-ho Kim, Yongin-si (KR); Jung-woo Choi, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 908 days.

(21) Appl. No.: 12/546,878

(22) Filed: Aug. 25, 2009

(65) Prior Publication Data

US 2010/0150382 A1 Jun. 17, 2010

(30) Foreign Application Priority Data

Dec. 17, 2008 (KR) ..... 10-2008-0128531

(51) Int. Cl.
*H04R 5/02* (2006.01)
*H04R 3/12* (2006.01)

(52) U.S. Cl.
CPC ..... *H04R 3/12* (2013.01)

(58) Field of Classification Search
CPC ..... H04R 3/12; H04R 1/02; H04R 5/02; H04R 5/04; H04R 5/607; H04S 3/002; H04S 7/302; H04S 3/02; G07F 17/32; G07F 17/3216; A63F 13/00; A61F 11/00; G10L 21/00
USPC ..... 381/1, 5, 10, 17, 18, 19, 20, 22, 302, 381/303, 304, 310, 56, 58, 59, 80, 307, 85, 381/86, 97, 98, 103, 119, 116, 117, 300; 700/94; 704/225; 379/388.03, 390.1, 379/390.03; 339/278, 280
See application file for complete search history.

(56) References Cited

U.S. PATENT DOCUMENTS 5,233,664 A * 8/1993 Yanagawa et al. ..... 381/89
5,438,624 A 8/1995 Lewiner et al.

(Continued)

FOREIGN PATENT DOCUMENTS

JP 5-41897 2/1993
JP 2006-025153 1/2006

(Continued)

OTHER PUBLICATIONS

Korean Notice of Allowance issued May 3, 2013 in counterpart Korean Patent Application No. 10-2008-0128531 (2 pages, in Korean).

*Primary Examiner* — Leshui Zhang
(74) *Attorney, Agent, or Firm* — NSIP Law

(57) ABSTRACT

Provided are apparatus and method for focusing sound so that a sound radiation pattern output from an array speaker system composed of a plurality of speakers may approach a target sound radiation pattern. The sound focusing apparatus uses a focusing filter formed in consideration of sound characteristics of the array speaker system. In addition, the sound focusing apparatus may compensate for delay and gain values of each channel generated when an input signal is replicated to a plurality of channels and output through an array speaker in the array speaker system.

11 Claims, 7 Drawing Sheets

(56) References Cited

U.S. PATENT DOCUMENTS

| | | | | |
|---|---|---|---|---|
| 2004/0151325 | A1 | 8/2004 | Hooley et al. | |
| 2005/0141735 | A1 | 6/2005 | Kim | |
| 2006/0204022 | A1 | 9/2006 | Hooley et al. | |
| 2007/0110268 | A1 | 5/2007 | Konagai et al. | |
| 2007/0230724 | A1 | 10/2007 | Konagai et al. | |
| 2007/0253575 | A1 | 11/2007 | Melanson et al. | |
| 2008/0089522 | A1 * | 4/2008 | Baba et al. | 381/17 |
| 2008/0165979 | A1 | 7/2008 | Takumai et al. | |
| 2008/0212786 | A1 | 9/2008 | Park | |
| 2009/0060237 | A1 | 3/2009 | Konagai et al. | |

FOREIGN PATENT DOCUMENTS

| | | |
|---|---|---|
| JP | 2006-238155 | 9/2006 |
| JP | 2007-300404 | 11/2007 |
| KR | 2002-0032954 | 5/2002 |
| KR | 10-2005-0064629 | 6/2005 |
| KR | 10-2005-0101571 | 10/2005 |
| KR | 10-2008-0080875 | 9/2008 |

* cited by examiner

APPARATUS AND METHOD FOR FOCUSING SOUND IN ARRAY SPEAKER SYSTEM

CROSS-REFERENCE TO RELATED APPLICATION

This application claims the benefit under 35 U.S.C. §119 (a) of a Korean Patent Application No. 10-2008-0128531, filed Dec. 17, 2008, the disclosure of which is incorporated herein in its entirety by reference for all purposes.

BACKGROUND

1. Field

The following description relates to an apparatus and method for focusing sound in an array speaker system.

2. Description of the Related Art

An array speaker system is used to control a direction of sound to be reproduced or to transmit sound to a specific region, by combining a plurality of speakers. According to a sound transmission principle generally referred to as directivity, a signal is transmitted in a predetermined direction by overlapping a plurality of sound source signals having different phases to increase the signal intensity in the predetermined direction.

Directivity may be implemented by arranging a plurality of speakers in a predetermined arrangement and controlling a sound source signal output through each speaker. In a common array speaker system, filter values, i.e., delay and gain values are calculated to be adjusted to a target beam pattern in advance to obtain a target frequency beam pattern.

SUMMARY

According to one general aspect, there is provided a method of focusing sound in an array speaker system, including: processing an input signal using a focusing filter to which a filter value corrected using sound characteristic information including magnitude and phase of an output signal per channel when the input signal is output through the array speaker system is applied; and compensating for delay and gain deviations with respect to a replicated input signal using a compensation filter formed on the basis of the delay and gain deviations of the replicated input signal generated while the input signal is replicated into as many signals as there are output channels by the focusing filter and output through the array speaker system.

The method may further include forming the focusing filter, which includes: correcting a transfer function using the sound characteristic information; and calculating a filter value of the focusing filter using the corrected transfer function. The filter value of the focusing filter may be calculated by a least-square error (LSE) method using the corrected transfer function and a filter value corresponding to a target pattern.

The method may further include determining the delay and gain deviations, which includes: generating the replicated input signals into signals distinguished from each other; outputting the generated signals using the array speaker system; measuring each output signal at the same distance from the array speaker system; and determining a difference between theoretically-estimated delays and gains of the signals which are replicated and then output per channel, and measured delays and gains of the measured signals which are replicated and then output per channel, as the delay and gain deviations.

The method may further include determining the delay and gain deviations, which includes: outputting the replicated input signal through the array speaker system; measuring each output signal at the same distance from the array speaker system; analyzing correlation between the replicated input signal and the measured signal; estimating delays and gains of the input signals based on the analyzed correlation; and determining the delay and gain deviations using a difference between the measured delays and gains of the signals and estimated delays and gains of the signals which are replicated and then output per channel.

According to another general aspect, there is provided an apparatus for focusing sound in an array speaker system, including: a focusing filter outputting an input signal to have a preset sound radiation pattern using a filter value corrected using sound characteristic information including magnitude and phase of an signal output through each channel of the array speaker system; and a compensation filter compensating for delay and gain deviations of each channel while the input signal is replicated into as many signals as there are output channels and then output through the array speaker system.

Other features and aspects will be apparent from the following detailed description, the drawings, and the claims.

Figure 1A:
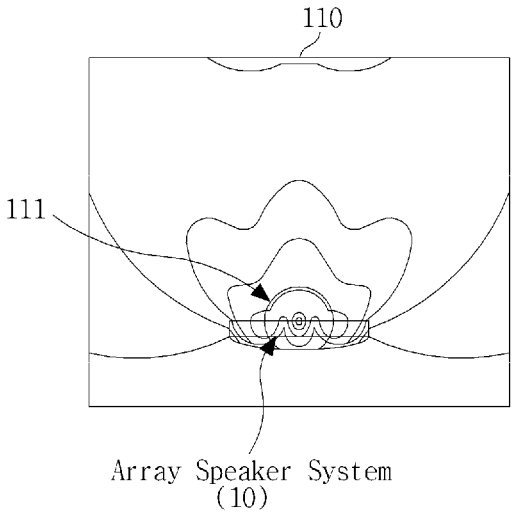
FIGS. 1A and 1B are diagrams illustrating examples of sound radiation patterns of an array speaker system.

Throughout the drawings and the detailed description, unless otherwise described, the same drawing reference numerals will be understood to refer to the same elements, features, and structures. The relative size and depiction of these elements may be exaggerated for clarity, illustration, and convenience

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

The term "sound radiation pattern" used herein may refer to a pattern of a sound field formed by sound radiated through a signal output device such as a speaker or an antenna. Sound field is a conceptual expression for a region affected by sound pressure around a sound source. Here, sound pressure is a force of sound energy, which is expressed as physical pressure. The sound radiation pattern may be obtained by receiving sound signals radiated from an array speaker system, measuring intensities of the sound signals at different distances using a measuring device for measuring an output signal, and graphing the intensities of the received sound signals.

Generally, a focusing filter controlling a sound radiation pattern (or a directional pattern) of an array speaker system is designed under the assumption that each speaker of an array speaker system outputs a signal to form the same sound radiation pattern, i.e., a monopole pattern. That is, the focusing filter is typically designed to operate in an idealized system, not in an actual array speaker system. However, in an array speaker system, the sound radiation pattern of a signal output from each speaker of the array speaker system varies with a position of the speaker and geometric arrangement of the speakers of the array speaker system. In addition, when the array speaker system is implemented in a real product, the sound radiation pattern may also be changed, for example, by a casing of the product.

Figure 1B:
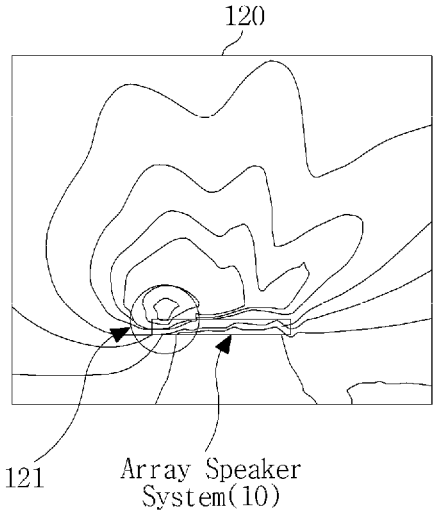

FIGS. 1A and 1B show examples of sound radiation patterns of an array speaker system 10.

In FIG. 1A, a directional pattern 110 represents a directional pattern of a sound signal output from a speaker disposed in a middle 111 of the array speaker system 10.

In FIG. 1B, a directional pattern 120 represents a directional pattern of a sound signal output from a speaker disposed at an edge 121 of the array speaker system 10.

Referring to FIGS. 1A and 1B, it can be understood that a sound radiation pattern may change due to a phenomenon such as a sound diffraction resulting from a position of a speaker.

Figure 2:
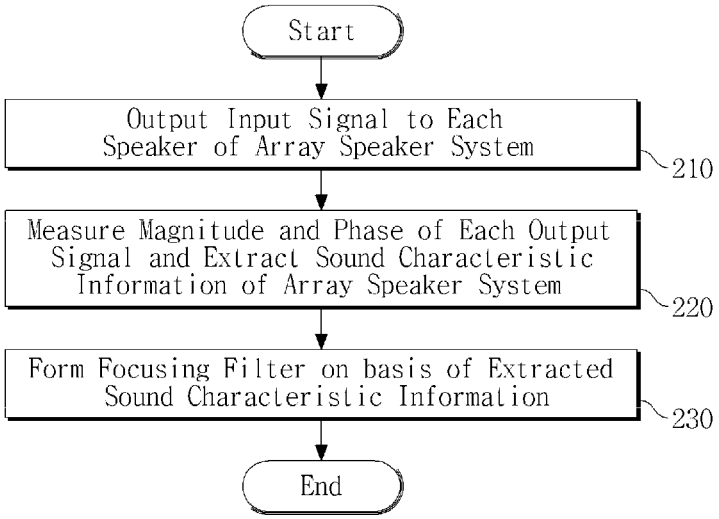
FIG. 2 is a flowchart illustrating an exemplary method of forming a focusing filter to improve focusing performance in consideration of sound characteristics of an array speaker system.

FIG. 2 is a flowchart illustrating an exemplary method of forming a focusing filter to improve focusing performance in consideration of sound characteristics of an array speaker system.

In operation 210, an input signal is replicated corresponding to the number of output channels, and output through each speaker of the array speaker system.

In operation 220, magnitude and phase of the output signal are measured, and sound characteristic information of the array speaker system, including magnitude and phase of an output signal per channel, is extracted therefrom.

In operation 230, a focusing filter is formed based on the extracted sound characteristic information of the array speaker system.

An exemplary method of measuring sound characteristics of an output signal is described below with reference to FIG. 3.

Figure 3:
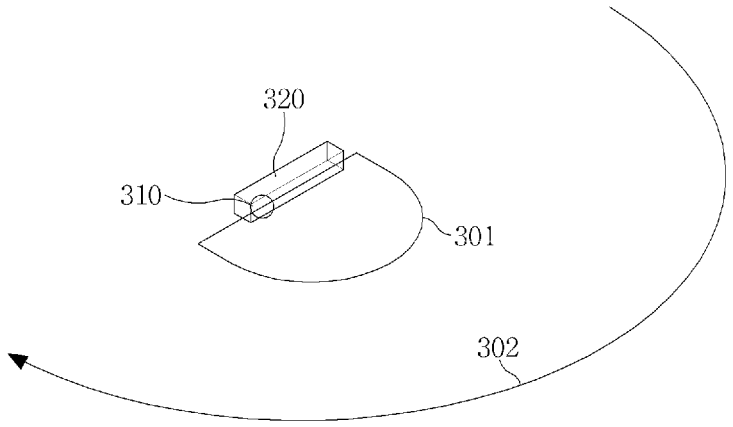
FIG. 3 is a diagram illustrating an exemplary method of measuring sound characteristics of an array speaker system.

FIG. 3 shows an exemplary array speaker system 320 having a speaker 310.

Referring to FIG. 3, when a sound signal is output from the speaker 310, a directional pattern denoted by reference numeral 301 may be formed.

A microphone array, which is composed of a plurality of measuring devices, e.g., a plurality of microphones, may be installed at a position 302 spaced a predetermined distance from the array speaker system 320, the measuring devices being separated from each other at predetermined intervals. A reference signal may be output to measure sound characteristics per channel of the array speaker system 320, and in each channel, an amplitude and phase of a sound signal input through each microphone may be measured, so as to extract sound characteristics of the array speaker system 320.

A transfer function between a measuring device and a measuring position for each direction may be measured by measuring an output signal for each channel at a measuring position spaced a predetermined distance from the array speaker system 320. A value of the transfer function calculated for each channel may be obtained from a directional characteristic value for each channel by calculating gain and delay values on the basis of a reference angle, for example, 90 degrees with respect to a plane of each source of an array speaker system.

According to one implementation, the directional characteristic value may be reflected in a theoretical transfer function (G).

A directional characteristic ($b_i$) of each source of an array speaker system may be measured as described above, the measured directional characteristic data may be combined per channel, and thus a sound characteristic matrix (B) of the array speaker system may be formed according to Equation 1:

$$B=[b_1\ b_2 \ldots b_n] \quad \text{[Equation 1]}$$

Referring again to FIG. 2, in operation 230, a focusing filter for filtering an input signal based on the extracted sound characteristics may be formed.

Assuming that a transfer function matrix between the array speaker system and the measuring position is G, and the sound characteristic matrix of the array speaker system is B, a transfer function $G_c$ corrected may be defined by Equation 2:

$$G_c=B\cdot G \quad \text{[Equation 2]}$$

Here, a response pattern $H_c$ by a response pattern $w_c$ of the corrected filter may be defined by Equation 3:

$$H_c=G_c w_c \quad \text{[Equation 3]}$$

Assuming that a target response pattern (also referred to as a target pattern) is D, an error between the target pattern D and the response pattern $H_c$ may be defined by Equation 4:

$$E=|D-H_c|^2=|D-G_c w_c|^2 \quad \text{[Equation 4]}$$

A filter value $w_c$ corrected by a method of designing a filter using least-square error (LSE) may defined by Equation 5:

$$w_c=(G_c^H G_c)^{-1} G_c^H D \quad \text{[Equation 5]}$$

That is, a transfer function used for focusing filter calculation of the array speaker system may be corrected using the measured sound characteristics, and the corrected transfer function may be used to calculate a focusing filter value, resulting in forming a focusing filter reflecting the sound characteristics of the array speaker system.

Generally, an array speaker system using a plurality of channels is designed under the assumption that there is no error in gain and time delay between channels when an input signal is replicated and output to the plurality of channels. However, while an actual signal replicated and replicated signal are transmitted and amplified from each channel, delay and gain may deviate between signals of each channel.

Figure 4:
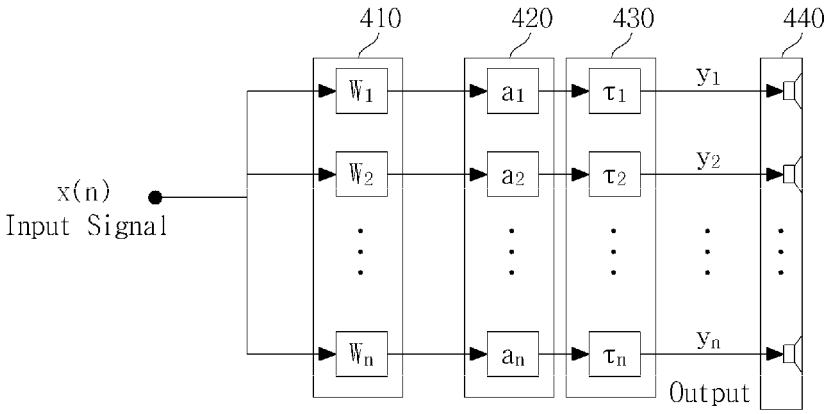
FIG. 4 is a diagram illustrating delay and gain distortions of filtered signals generated in an array speaker system.

FIG. 4 shows an array speaker system 440, and delay and gain distortions with respect to filtered signals generated in the array speaker system 440 are further described referring to FIG. 4.

Referring to FIG. 4, a gain deviation 420 and a delay deviation 430 generated per channel before the input signal replicated into multi-channel signals and then filtered by a filter 410, is transferred per channel to the array speaker system 440. These deviations 420 and 430 may distort a sound source signal of the filter designed for focusing, and thus degrade focusing performance of the array speaker system 440.

In order to reduce the delay and gain deviations per channel in an array speaker system, delay and gain deviations per channel in the array speaker system are determined.

To determine the delay and gain deviations per channel, a reference signal is input to the array speaker system, replicated into multi-channel signals without filtering in the array speaker system, and compared with an output reference signal from an output device. For example, when a microphone is attached to each speaker of the array speaker system, delay and gain values of an output reference signal transferred through each channel may be measured with reference to the input reference signal. However, it may be difficult to precisely measure the delay and gain deviations for each channel.

Figure 5:
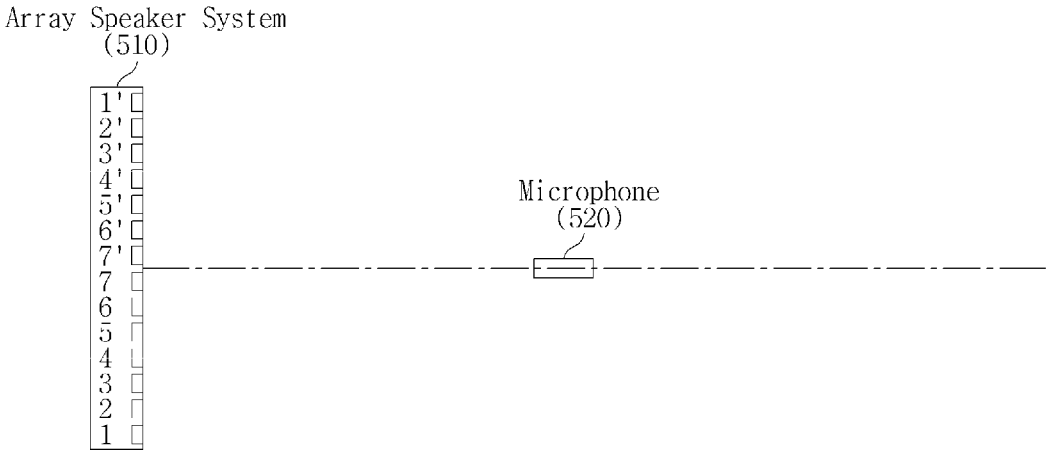
FIG. 5 is a diagram illustrating an exemplary condition to measure delay and gain deviations due to a system per channel.

In another example, delay and gain deviations per channel in the array speaker system may be estimated from an output signal per channel of the array speaker system, which is measured under a measurement condition shown in FIG. 5.

FIG. 5 shows an exemplary measurement condition for measuring delay and gain deviations per channel.

Referring to FIG. 5, a measuring device (microphone) 520 is disposed a predetermined distance from an array speaker system 510. Thus, time delay and attenuation of sound pressure may occur according to a geometric distance between each speaker and a measuring position. Considering theoretical attenuation of sound pressure, a resultant signal may be calculated theoretically. Additional delay and gain changes may occur from the measured delay and gain values according to other measurement conditions except for the delay and gain values between channels. Using the geometric distance information between each speaker and the measuring position, delay and gain values of the measured signal may be theoretically estimated.

Thus, the delay and gain deviations generated in the array speaker system 510 may be estimated by calculating delay and gain deviations between a measured signal and a theoretically-calculated signal. A method of determining delay and gain deviations per channel of a signal generated in an array speaker system will be further described with reference to FIGS. 6 and 7.

Figure 6:
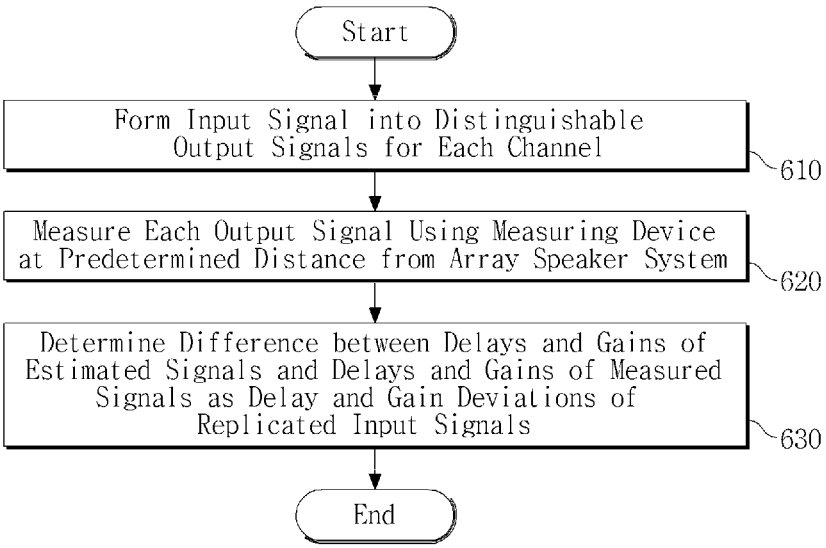
FIG. 6 is a flowchart illustrating an exemplary method of determining delay and gain deviations generated due to an array speaker system.

FIG. 6 is a flowchart illustrating an exemplary method of determining delay and gain deviations generated by an array speaker system.

In operation 610, an input signal is replicated into, for example, as many signals as there are output channels and output as output signals distinguished from each other per channel. For example, an input signal of a channel may be output through the channel unaffected by other output signals by applying distinguishable filter values to the input signal for each channel. In other words, in order to output signals having different frequencies per channel, different band pass filters may be used to apply the input signal for each channel. In another example, output signals may be generated to have a larger difference in gain and delay values of each signal than errors between channels.

In operation 620, an output signal output from each channel of the array speaker system is measured by a measuring device spaced a predetermined distance from the array speaker system. Here, the measuring device may be disposed a predetermined distance from the center of a front surface of the array speaker system, for example, a distance suitable for listening to sound using the array speaker system, to reduce errors in practical application.

In operation 630, for each channel, the difference between estimated delay and gain values of a theoretical signal replicated and output by the channel, and delay and gain values of an actually-measured signal replicated and output by the channel, is determined as delay and gain deviations of the replicated input signal.

Figure 7:
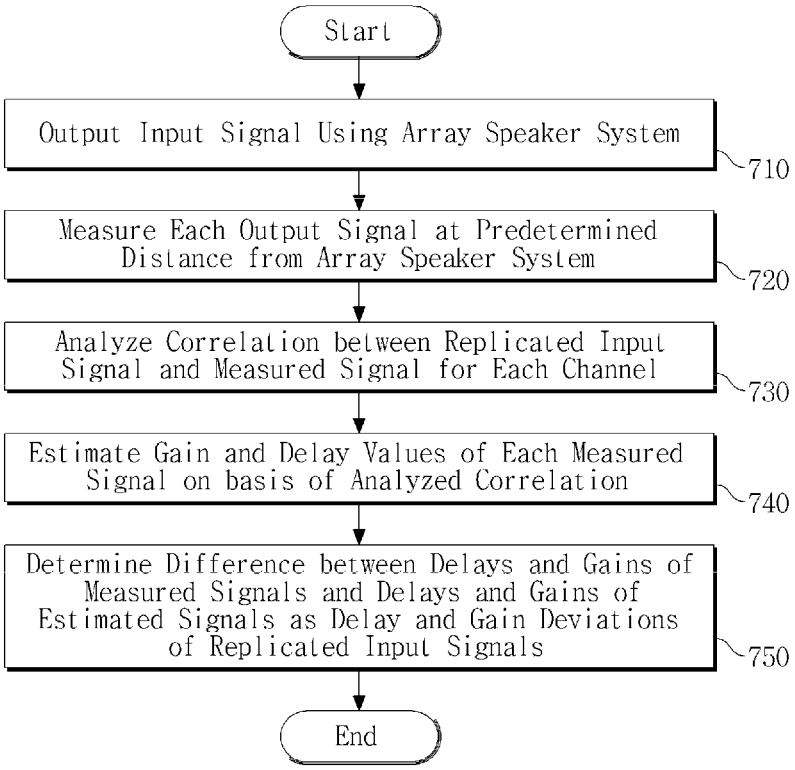
FIG. 7 is a flowchart illustrating another exemplary method of determining delay and gain deviations generated due to an array speaker system.

FIG. 7 is a flowchart illustrating another method of determining delay and gain deviations generated by an array speaker system.

In operation 710, an input signal is replicated into, for example, as many signals as the number of output channels, and output using the array speaker system.

In operation 720, an output signal of each channel is measured at a predetermined distance from the array speaker system.

In operation 730, correlation between the replicated input signal of each channel and a corresponding measured signal is analyzed.

In operation 740, delay and gain values of the measured signal are estimated on the basis of the analyzed correlation.

In operation 750, for each channel, the difference between measured delay and gain values of the replicated output signal and estimated delay and gain values is determined as delay and gain deviations of the replicated input signal.

Figure 8:
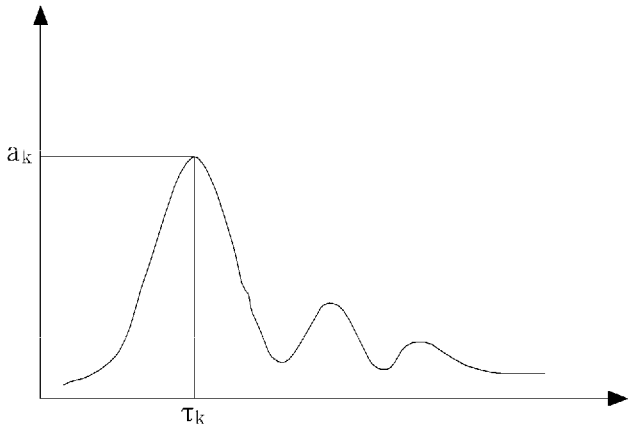
FIG. 8 is a graph illustrating an example of estimated delay and gain errors per channel using a measured channel compensation signal.

FIG. 8 is a graph illustrating delay and gain errors per channel estimated using a measured channel compensation signal.

Correlation between an input signal x and a measured signal y with respect to n number of sample signals may be expressed by Equation 6:

$$\gamma_{xy} = \frac{\sum_{i=1}^{n} x_i y_i n\overline{xy}}{(n-1)S_x S_y} \quad \text{[Equation 6]}$$

Here, $S_x$ and $S_y$ are standard deviation values of the input signal x and the measured signal y, respectively, and $\overline{x}$ and $\overline{y}$ are mean values of the input signal and the measured signal. i denotes a sample from 1 to n (n is the total number of samples). For example, when an input signal is output through one output device of an array speaker system and measured by a measuring device, a time delay $\tau$ is generated between the two signals, a peak value of the input signal is $c_x$, and a peak value of the measured signal is $c_y$. In practical application, these values of the measured signal may not be obtained by direct measurement, but may be obtained by a calculation using a correlation value.

In FIG. 8, the delay value $\tau_k$ may be obtained by multiplying a correlation $\gamma_{xy}$, a number of samples having maximum correlation and a sampling interval, and here, the correlation value may be set as a gain value $a_k$. Through correlation analysis, if it is concluded that an output signal is derived from an input signal, a delay value between the two signals may become a time delay value $\tau_k$ having the maximum correlation value, and a gain deviation may become a relative magnitude between the input and output signals. For example, when the input and output signals are identical, the correlation analysis value is 1, and the time delay value is a time delay value between the input and output signals.

Figure 9A:
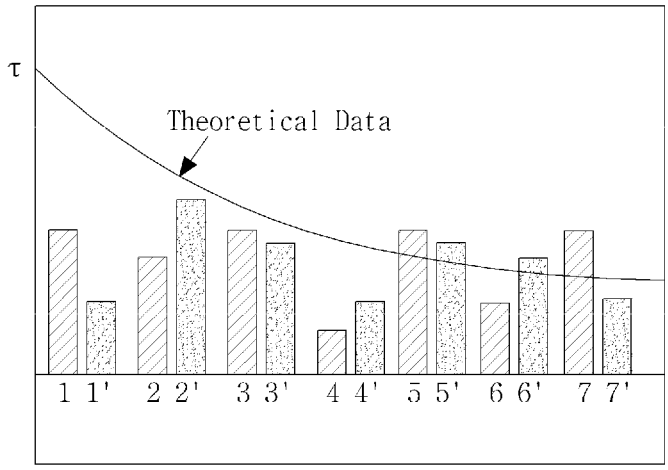
FIG. 9A is a graph illustrating an example of delay values of a measured signal and a theoretically-estimated signal per channel.

FIG. 9A is a graph illustrating exemplary delay values of a measured signal and a theoretically-estimated signal, per channel.

A compensation delay value may be calculated using a difference between a theoretical delay value according to a geometric distance between each speaker and a measuring position, and a delay value obtained by analyzing a measured signal. For example, when the difference between the theoretical delay value and the obtained delay value is $\tau$, a delay value applied to a compensation filter value to compensate for the delay value deviation is $-\tau$.

Figure 9B:
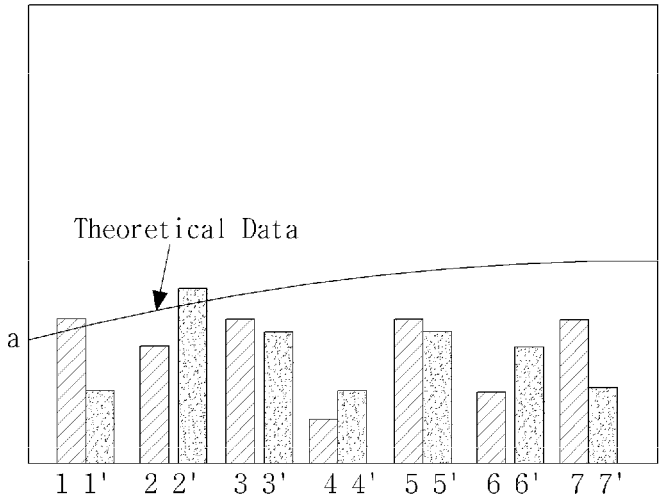
FIG. 9B is a graph illustrating another example of gain values of a measured signal and a theoretically-estimated signal per channel.

FIG. 9B is a graph illustrating exemplary gain values of a measured signal and a theoretically-estimated signal, per channel.

A compensation gain value between channels may be calculated using a ratio of an estimated gain value obtained by theoretical calculation according to a geometric distance between each speaker and an actually-measured gain (sound pressure) value for each channel in measuring point. For example, when the obtained gain ratio is a, a gain value applied to a compensation filter value to compensate the gain deviation is 1/a.

Figure 10:
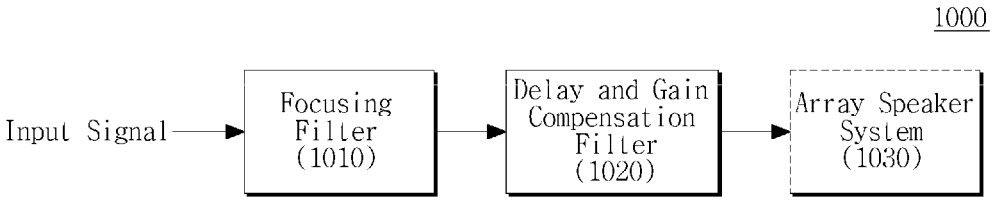
FIG. 10 is a block diagram illustrating an exemplary apparatus for focusing sound by correcting system errors and sound characteristics.

FIG. 10 illustrates an exemplary apparatus 1000 for focusing sound by correcting system errors and sound characteristics.

The exemplary apparatus 1000 for improving focusing performance of an array speaker system includes a focusing filter 1010 and a delay and gain compensation filter 1020. This apparatus may be combined or implemented with an array speaker system 1030.

The focusing filter 1010 applies a filter value corrected using sound characteristic information, including magnitude and phase of an output signal per channel, to an input signal when the input signal is output through the array speaker system 1030. For example, the focusing filter 1010 replicates the input signal into a multi-channel signals, and processes the multi-channel signals using a filter $w_c$ designed using a corrected transfer function $G_c$ where reflects a system sound characteristic B is reflected to transfer function $c_T$.

In addition, the delay and gain compensation filter 1020 compensates for delay and gain values generated by the array speaker system, and output signals through the array speaker system 1030. For example, the delay and gain compensation filter 1020 compensates for delay and gain deviations per channel while the input signal is replicated into as many signals as the number of output channels, and output through the array speaker system 1030.

Accordingly, sound focusing performance may be improved by designing a filter in consideration of gain and delay deviations between channels generated during replication, transmission and amplification of a signal in the array speaker system, and sound characteristics that depend on an installation structure of the array speaker system.

Figure 11:
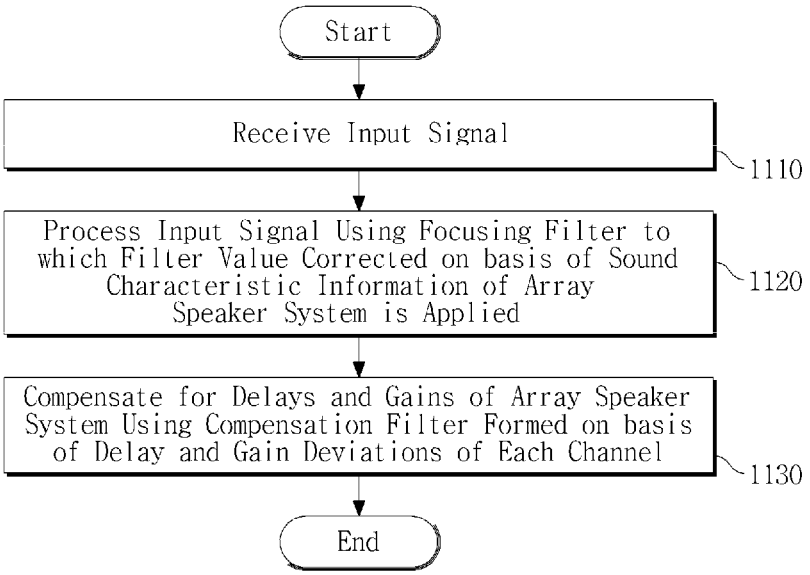
FIG. 11 is a flowchart illustrating an exemplary method of focusing sound by correcting system errors and sound characteristics.

FIG. 11 is a flowchart illustrating an exemplary method of focusing sound by correcting system errors and sound characteristics.

In operation 1110, an apparatus for focusing sound according to an exemplary implementation described above receives an input signal.

In operation 1120, the input signal is processed using a focusing filter to which a filter value corrected using sound characteristic information including magnitude and phase of an signal output through each channel of an array speaker system, is applied.

In operation 1130, delays and gains of the array speaker system are compensated for using a compensation filter formed on the basis of delay and gain deviations of a replicated input signal, which are generated while an input signal is replicated into, for example, as many signals as the number of output channels, and output through the array speaker system.

The methods described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa. In addition, a computer-readable storage medium may be distributed among computer systems connected through a network and computer-readable codes or program instructions may be stored and executed in a decentralized manner.

According to certain example(s) described above, provided are an apparatus and method for focusing sound, which may improve focusing performance of an array speaker system by reflecting an error generated by the array speaker system in a filter design.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A method of focusing sound in an array speaker system, the method comprising:

processing an input signal, using a focusing filter, by applying a filter value corrected using sound characteristic information when the input signal is output through the array speaker system, wherein the sound characteristic information comprises magnitude and phase of an output signal per channel; and compensating for delay and gain deviations of replicated input signals using a compensation filter, wherein the compensation filter is formed based on the delay and gain deviations of the replicated input signals generated, wherein the replicated input signals comprise the input signal being replicated into a number of signals equal to a number of output channels by the focusing filter and output through the array speaker system, wherein the delay and gain deviations are differences between measured delays and gains of the signals, which are replicated and output per channel, and theoretically-estimated delays and gains of the signals, which are replicated and output per channel, wherein the measured delays and gains of the signals are obtained based on a correlation, a number of samples, and a sampling interval, and wherein the theoretically-estimated delays and gains of the signals are based on a geometric distance between each speaker of the array speaker system and a measuring position.

2. The method of claim 1, further comprising:

forming the focusing filter by correcting a transfer function using the sound characteristic information, and calculating a filter value of the focusing filter using the corrected transfer function.

3. The method of claim 2, wherein the filter value of the focusing filter is calculated by a least-square error (LSE) method using the corrected transfer function and a filter value corresponding to a target pattern.

4. The method of claim 1, further comprising:

determining the delay and gain deviations by generating the replicated input signals into signals distinguished from each other, outputting the generated signals using the array speaker system, and measuring each output signal at the same distance from the array speaker system.

5. An apparatus for focusing sound in an array speaker system, the apparatus comprising:

a focusing filter configured to output an input signal to have a preset sound radiation pattern using a filter value corrected using sound characteristic information, wherein the sound characteristic information comprises magnitude and phase of an signal output through each channel of the array speaker system; and a compensation filter configured to compensate for delay and gain deviations of each channel, while the input signal is replicated into a number of signals equal to a number of output channels and output through the array speaker system, wherein the delay and gain deviations are differences between measured delays and gains of the signals, which are replicated and output per channel, and theoretically-estimated delays and gains of the signals, which are replicated and output per channels;

wherein the measured delays and gains of the signals are obtained based on a correlation, a number of samples, and a sampling interval, and wherein the theoretically-estimated delays and gains of the signals are based on a geometric distance between each speaker of the array speaker system and a measuring position.

6. The apparatus of claim 5, wherein the focusing filter is formed using a filter value calculated based on a transfer function corrected using the sound characteristic information.

7. The apparatus of claim 6, wherein the filter value of the focusing filter is a value calculated by a least-square error (LSE) method using the corrected transfer function and a filter value corresponding to a target pattern.

8. A computer program embodied on a non-transitory computer readable medium to focus sound in an array speaker system, the computer program being configured to control a processor to perform:

processing an input signal, using a focusing filter, by applying a filter value corrected using sound characteristic information when the input signal is output through the array speaker system, wherein the sound characteristic information comprises magnitude and phase of an output signal per channel; and compensating for delay and gain deviations of replicated input signals using a compensation filter, wherein the compensation filter is formed based on the delay and gain deviations of the replicated input signals generated, wherein the replicated input signals comprise the input signal being replicated into a number of signals equal to a number of output channels by the focusing filter and output through the array speaker system, wherein the delay and gain deviations are differences between measured delays and gains of the signals, which are replicated and output per channel, and theoretically-estimated delays and gains of the signals, which are replicated and output per channel, wherein the measured delays and gains of the signals are obtained based on a correlation, a number of samples, and a sampling interval, and wherein the theoretically-estimated delays and gains of the signals are based on a geometric distance between each speaker of the array speaker system and a measuring position.

9. The computer program embodied on a non-transitory computer readable medium of claim 8, further comprising:

forming the focusing filter by correcting a transfer function using the sound characteristic information, and calculating a filter value of the focusing filter using the corrected transfer function.

10. The computer program embodied on a non-transitory computer readable medium of claim 9, wherein the filter value of the focusing filter is calculated by a least-square error (LSE) method using the corrected transfer function and a filter value corresponding to a target pattern.

11. The computer program embodied on a non-transitory computer readable medium of claim 8, further comprising:

determining the delay and gain deviations by generating the replicated input signals into signals distinguished from each other, outputting the generated signals using the array speaker system, and measuring each output signal at the same distance from the array speaker system.

* * * * *